United States Patent [19]

Engdahl, Jr.

[11] 4,022,382

[45] May 10, 1977

[54] SURFACE CLEANING DEVICE

[76] Inventor: Arnold Bernard Engdahl, Jr., 15282 Moulins Circle, Irvine, Calif. 92714

[22] Filed: Apr. 21, 1976

[21] Appl. No.: 679,051

[52] U.S. Cl. ..... 239/287; 134/172; 239/532; 239/557; 239/566

[51] Int. Cl.[2] ..... B05B 1/20; B05B 15/06; B08B 3/02

[58] Field of Search ..... 239/273, 279, 280–281, 239/286, 287, 532, 536, 550, 557, 566, 567; 134/172; 15/320

[56] References Cited

UNITED STATES PATENTS

| | | | |
|---|---|---|---|
| 2,692,163 | 10/1954 | Geel | 239/287 |
| 3,202,362 | 8/1965 | Wright | 239/287 |
| 3,770,210 | 11/1973 | Veltkamp | 239/550 X |
| 3,931,931 | 1/1976 | Otis | 239/287 |

*Primary Examiner*—Evon C. Blunk
*Assistant Examiner*—Andres Kashnikow
*Attorney, Agent, or Firm*—Jackson & Jones Law Corporation

[57] ABSTRACT

A high pressure wall of water is directed at a surface to be cleaned from a plastic-type discharger tube having nozzles mounted therein. The discharge tube is joined at right angles to a plastic-type inlet tube. The inlet tube connects to a garden hose through a convenient valve and coupling arrangement. The discharge tube has caster-type wheels mounted thereto approximately midway between the union of the discharge tube and inlet tube and the respective ends of the discharge tube.

9 Claims, 2 Drawing Figures

SURFACE CLEANING DEVICE

BACKGROUND OF THE INVENTION

The present invention relates to a surface cleaning device and more specifically pertains to new and improved sweeping devices adapted to utilize water, wherein the water is sprayed therefrom in a plurality of jets against the surface to be swept or cleaned.

Prior art devices of this type are generally made of steel tubing or pipe, are very rugged and heavy because they are intended for heavy duty applications and for the cleaning of large surface areas. These prior art sweeping devices, because of their construction, are cumbersome and difficult to maneuver and therefore are ineffective for the cleaning of smaller areas, such as decking around a swimming pool or the garage floor and driveway of a residence.

OBJECTS AND SUMMARY OF THE INVENTION

An object of this invention is to provide a lightweight, easy to maneuver surface cleaning device for cleaning surfaces such as driveways and pool decking.

Another object of this invention is to provide a surface cleaning device made of durable plastic or hard-rubber parts; said device being mounted on caster-type wheels at locations on said device that provide for maximum support and maneuverability.

These objects and the general purpose of the invention are accomplished as follows. PVC-type tubing is used for a discharge tube having plastic nozzles therein to direct a wall of water, at relatively high pressure, at the surface to be cleaned. This discharge tube is coupled to a PVC-type inlet tube. The inlet tube is connected to a garden-type hose through any convenient coupler-valve arrangement. The discharge tube is mounted on a pair of caster-type wheels at locations on the tube that are approximately half-way between the junction of the discharge and inlet tubes and the respective ends of the discharge tube. The nozzles in the discharge tube are placed in the discharge tube at an angle that will divert the wall of water to the front of the surface cleaner when it is in an operating position.

BRIEF DESCRIPTION OF THE DRAWINGS

Other objects and many of the attendant advantages of this invention will be readily appreciated as the same becomes better understood by reference to the following detailed description when considered in conjunction with the accompanying drawings in which like reference numerals designate like parts throughout the figures thereof, and wherein.

DESCRIPTION OF THE PREFERRED EMBODIMENT

Figures 1, 2:
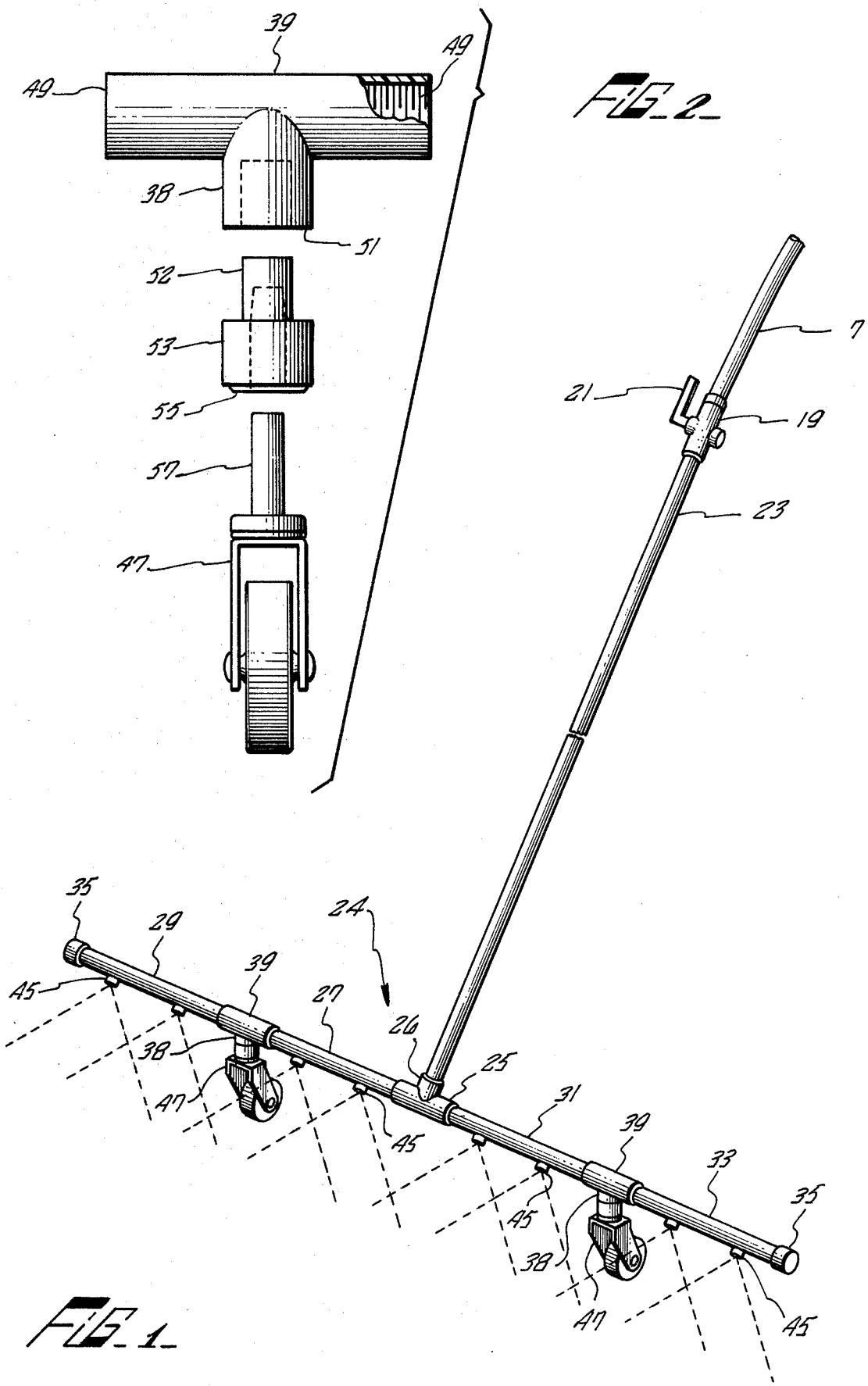
FIG. 1 is a perspective illustration of the cleaning device according to the present invention.
FIG. 2 is an exploded elevation of the wheel mechanism of this invention and how it is fastened to the cleaning device.

The surface cleaning apparatus as illustrated in FIG. 1 has an inlet tube 23 which is preferably made of polyvinylchloride at a ¾ inch diameter. The inlet tube is connected to a discharge tube 24 which is really a plurality of tube segments 27, 29, 31 and 33. Each of these tube segments are the same type of polyvinylchloride tubing as the inlet tube 23. The inlet tube 23 is fastened to a coupling mechanism 19 which permits the coupling of a water hose 17, which may be of the ordinary garden variety type, thereto. The coupling mechanism 19 may also advantageously include a valve mechanism 21 for regulating the flow of water from the hose 17 into the inlet tube 23. The length of tubing 23 may be any convenient size, advantageous to facilitate manueverability of the device and avoid the requirement that the operator stoop during its operation. It has been found that a length of approximately 4 feet for inlet tubing 23 is very satisfactory.

The discharge tube 24 is fastened to the inlet tube 23 by a T fitting 25 which may be a standard ¾ inch PVC T coupling. The T fitting 25 couples inlet tube 23 to tube segments 27 and 31 of the discharge tube 24. Tube segments 29 and 33 are respectively coupled to tube segments 27 and 31 by T fitting 39. T fittings 39 may, like T fitting 25, be standard ¾ inch PVC T couplings. The ends of tube segments 29 and 33 of the discharge tube 24 are capped by suitable plastic capping means 35, which are preferably cemented into position by conventional PVC cement.

Each of the tube segments 27, 29, 31 and 33 of the discharge tube 24 have nozzles 45 inserted therein. These nozzles are made of plastic material press-fitted and glued into apertures in the tube segments 27, 29, 31 and 33. The T fittings 39 have their legs 38 aligned in parallel. These parallel legs 38 make an acute angle with the leg 26 of T fitting 25. It has been found that the most advantageous acute angle between the parallel legs 38 of T fittings 39 and the leg 26 of T fitting 25 is between 45° and 60°.

The plastic nozzles 45 that are inserted into and are a part of the tube segments 27, 29, 31 and 33 of the discharge tube 24, are pointed in a direction toward the front of the cleaning device when in an operating position as shown in FIG. 1. The tube segments 27, 29, 31 and 33 are positioned within the T fittings 39 and 25, so that the nozzles 45 make an acute angle in a forward direction with respect to the legs 38 of the T fittings 39. It has been found that the most advantageous angle is 45°.

The segments 27, 29, 31 and 33 of the discharge tube 24 advantageously are about 8 inches in length. A caster type wheel 47 is inserted into each of the T fittings 39, said caster being of the conventional universal-swivel type.

FIG. 2 illustrates how the casters 47 are fastened to the discharge tube 24 in a removable manner. Each T fitting 39 has a leg 38 with an aperture 51 therein. The horizontal portion of the T fitting 39 may have threads 49 at either end thereof, or may simply have apertures therein as does the leg 38. A plug 53 is fashioned to fit snugly within the aperture 51 of the leg 38. The plug is held in place by conventional PVC cement. The stub portion 52 of the plug 53 that is inserted into the leg 38 is preferably tapered, being narrower at the top than at the bottom to facilitate ease of insertion and provide a very snug fit between the member 52 and the aperture 51 in the leg 38 of the T fitting 39. The plug 53 has an aperture therein that receives a sleeve 55 for the stud 57 of the caster wheel 47. The sleeve 55 is simply press fitted into this plug 53 much in the same way that it is press fitted into the wood leg of a chair or other similar piece of furniture.

By providing placement of the caster wheels 47 equidistant between the junction T fitting 25 and the ends of the discharge tubing 24, and manufacturing the entire cleaning device from PVC-type plastic tubing material, a light-weight easy to maneuver surface cleaning device is provided.

Obviously, many modifications and variations of the present invention are possible in the light of the above teachings. It is therefore to be understood that within the scope of the appended claims the invention may be practiced otherwise than as specifically described.

What is claimed is:

1. A surface cleaning device for cleaning substantially flat surfaces, comprising:

a discharge tube, said discharge tube including:

a first tube segment having at least one discharge nozzle therein, a cap closing a first end of said tube segment, the second end of said tube segment being fastened to a first T fitting;

a second tube segment having at least one discharge nozzle therein, a first end of said second tube segment being fastened to said first T fitting in line with said first tube segment, the second end of said tube segment being fastened to a second T fitting;

a third tube segment having at least one discharge nozzle therein, a first end of said first tube segment being fastened to said second T fitting, in line with said second tube segment, the second end of said third tube segment being fastened to a third T fitting;

a fourth tube segment having at least one discharge nozzle therein, a first end of said fourth tube segment being fastened to said third T fitting, in line with said third tube segment, a cap closing the second end of said fourth tube segment;

an inlet tube connected to said second T fitting, said inlet tube having a coupling means attached thereto for connection to a water hose; and a pair of caster-type wheels, one connected to said first T fitting, the other connected to said third T fitting.

2. The surface cleaning device of claim 1 wherein said first, second, third and fourth tube segments are equal in length.

3. The surface cleaning device of claim 2, further comprising:

plug means for the upstanding leg of said first and third T fittings, each of said plug means sized to seal the opening in the leg of its respective T fitting and having an aperture therein to receive the stud sleeve of a caster type wheel.

4. The surface cleaning device of claim 3, wherein said first and third T fittings have their leg portions oriented at an acute angle with the leg portion of said second T fitting.

5. The surface cleaning device of claim 4 wherein said first, second, third and fourth tube segments are fastened to said first and third T fittings so as to orient the nozzles in the respective tube segments at an acute angle with the leg portion of said first and third T fittings, the leg portion of said first and third T fittings being parallel.

6. The surface cleaning device of claim 1, further comprising:

plug means for the upstanding leg of said first and third T fittings, each of said plug means sized to seal the opening in the leg of its respective T fitting and having an aperture therein to receive the stud sleeve of a caster type wheel.

7. The surface cleaning device of claim 1, wherein said first and third T fittings have their leg portions oriented at an acute angle with the leg portion of said second T fitting.

8. The surface cleaning device of claim 7, wherein said first, second, third and fourth tube segments are fastened to said first and third T fittings so as to orient the nozzles in the respective tube segments at an acute angle with the leg portion of said first and third T fittings, the leg portions of said first and third T fittings being parallel.

9. The surface cleaning device of claim 7, wherein the leg portions of said first and third T fittings are parallel.

* * * * *

UNITED STATES PATENT AND TRADEMARK OFFICE

CERTIFICATE OF CORRECTION

PATENT NO. : 4,022,382

DATED : May 10, 1977

INVENTOR(S) : Arnold Bernard Engdahl, Jr.

It is certified that error appears in the above-identified patent and that said Letters Patent are hereby corrected as shown below:

In Column 2, line 16, "fitting" should be --fittings--.

In Column 3, line 26, "first" second occurrence, should be --third--.

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*